US006701812B1

(12) United States Patent
Sawamura

(10) Patent No.: US 6,701,812 B1
(45) Date of Patent: Mar. 9, 2004

(54) SCREW CATCHER FOR POWER DRIVEN SCREWDRIVERS

(76) Inventor: Katurou J Sawamura, 77-2 Aza Doomae, Nakaneko, Hanamaki City, Iwate Pref. (JP)

( * ) Notice: Subject to any disclaimer, the term of this patent is extended or adjusted under 35 U.S.C. 154(b) by 0 days.

(21) Appl. No.: 09/706,566

(22) Filed: Nov. 6, 2000

(30) Foreign Application Priority Data

Nov. 11, 1999 (JP) ..... 11-320801

(51) Int. Cl.[7] ..... B25B 23/10
(52) U.S. Cl. ..... 81/453; 81/452
(58) Field of Search ..... 81/452, 453

(56) References Cited

U.S. PATENT DOCUMENTS 2,576,742 A * 11/1951 Wolny ..... 81/453
2,706,506 A * 4/1955 Wagner ..... 81/453
3,244,208 A * 4/1966 McKenzie ..... 81/453
6,244,141 B1 * 6/2001 Han ..... 81/453

* cited by examiner

*Primary Examiner*—James G. Smith

(57) ABSTRACT

An attachment means which attaches the device close to the front end of the bit of a power driver or an electric screwdriver, a screw capturing chuck means with several elastic holding fingers, the front end of said holding fingers being placed around the circumference of an opening in which the head of the screw is engaged, spring means when the front end of the said screw chuck receives a force in the opposite direction from the direction of a screw being screwed by the bit, the spring means allows retraction of the screwchuck, and a caliper adjustment means that is attached to the said screw capturing device and adjusts the inner diameter of the opening for receiving the screw by the resilient fingers.

10 Claims, 1 Drawing Sheet

SCREW CATCHER FOR POWER DRIVEN SCREWDRIVERS

BACKGROUND OF THE INVENTION

Customarily, when a screw is tightened by a power driver or an electric screwdriver, the screw is sometimes driven by the use of a magnet to hold a screw to a bit of an electric screwdriver.

However, since such screw tightening work attaches the head of a screw to the front end of an electric screwdriver, for example, a screw needs to be held by fingertips of an available hand. Or, if a screw is not screwed tightly, a screw needs to be supported by fingertips of an available hand. Such a supporting action occupies both hands of an operator, resulting in low work efficiency. Also, in a work environment with an unstable ground such as a construction site, it has always been inconvenient.

Since a screw that is driven by the front end of a driven screwdriver is not necessarily tight or not necessarily stable, a screw must be carefully tightened for small parts. As a result, an operator has to work hard and he or she tends to get more exhausted.

In order to solve the above problems with known technology, it is known to stabilize a screw at the driving end of an electric screwdriver by vacuuming the screw by the suction pressure of the air in Japanese Patent Application Hei 10-375218.

However, the above requires an air suction pressure generating apparatus. It causes a problem of requiring new equipment investment if the work place does not have such equipment.

Other screw capturing devices with manually positioned spring fingers mounted on a screwdriver are known or with automatic screw catchers of different types.

SUMMARY OF THE INVENTION

An object is to provide a screw capturing device for use with a power driver or an electric screwdriver that does not require vacuum, can be easily attached to or detached from a bit of an electric screwdriver, and does not interfere with, but makes easier, screw tightening work.

Furthermore, the invention can be made to correspond to several types of screws with different sizes, firmly capture the head of the screw, and can securely perform the screw tightening work.

Another object is to provide a screw capturing apparatus for a power driver or an electric screwdriver that enables visual confirmation that the head of the screw is captured and can perform the screw tightening work securely and safely.

And, another object is to provide a screw capturing apparatus for a power driver or an electric screwdriver that is light and small, and its components can be easily manufactured and assembled.

Because of the above construction, this apparatus can be adjusted to match the size of the screw. By operating the caliper adjustment means, the inner diameter of the opening part of the screw capturing device can be adjusted to match the diameter of the head of the screw to be tightened. When the front end of a power driver or an electric screwdriver is used with a screw supplier and the head of the screw is inserted into the opening between them, the elastic holding fingers hold the head of the screw. When the screwdriver that holds the screw is moved toward an object to place the screw in a screw hole of the object and the screwdriver is pushed toward the screw hole to turn the bit, the holding fingers receive the force in the opposite direction from the direction of a screw insertion as the screw enters into the screw hole. Since the holding fingers are pushed against the spring loaded means, it will not be a hindrance to screw tightening. When the screw is tightened and the screwdriver is detached from object, the holding fingers return to the initial position by the spring loaded means.

It is preferred that the screw capturing device is formed entirely of transparent materials or at least the holding fingers. If the holding fingers are transparent, the screw can be tightened securely and safely while visually confirming the status of screw capturing.

Other objects and advantages of the invention will become apparent from consideration of the drawings forming part of this application.

DESCRIPTION OF THE PREFERRED EMBODIMENT

Figure 1:
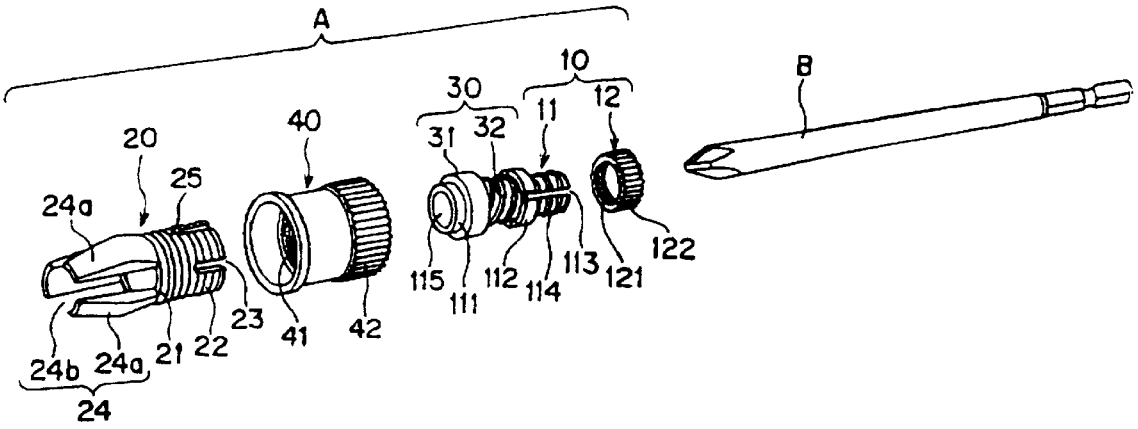
FIG. 1 is an exploded perspective view of an example of the invention.

As seen in the drawings, A indicates the screw capturing apparatus of this invention, and B indicates a bit of a power driver or an electric screwdriver sold in retail stores and referred to hereinafter simply as a screwdriver.

The screw capturing apparatus A has an attachment means 10 to attach the device A to the screwdriver bit B. The attachment means 10 is composed of a bushing 11 and an attachment nut 12 that attaches the bushing 11 to the bit B. The bushing 11 is formed generally cylindrical and has flanges 111 and 112 in the front end and the mid-section. Several slots 113 are formed longitudinally from the flange 112 in the mid-section to the rear end of the bushing 11. A screw thread 114 is cut on the outer circumference of the rear end of the bushing 11.

The bit B of the electric screwdriver can be inserted into a hole 115 internal to the bushing 11 in the direction of its axis. In the example shown, screw thread 121 is cut on the inner circumference of the attachment nut 12. For example, a roughened surface 122 is cut on the outer circumference of the attachment nut 12 to be easily rotated by fingertips.

Therefore, after moving the bushing 11 with the bit B in its hole 115 to the place where the front end of the bit B extends through the front end of the bushing 11, the screw thread 121 of the nut 12 can be screwed to the screw thread 114 and is tightened by turning the nut 12 to attach the bushing 11 to an appropriate location close to the front end of the bit B.

Another device to attach the bushing 11 to the bit B is, for example, a set screw or the like.

The screw capturing means A has the screwchuck-like device 20 to capture the head of a screw C at the front end of the bit B. The screwchuck 20 has a circular portion 21 in the center, an elastic circular portion 22 having slots 23 to add elasticity to the inner end, and screw holding means 24 at the outer end. A screw thread 25 is cut on the outer circumference of the circular potion 21 and the elastic circular portion 23. Also, the screw holding means 24 is extended outwardly from the circular portion 21 and has elastic holding fingers 24*a*, 24*a*, and 24*a* spaced circumferentially. The front end of each holding finger is located about the circumference and forms an opening 24*b* that can receive the head of the screw C. Also, each holding finger 24*a* is bent or formed to create a cam on the outer side of each holding finger 24*a*. The outer diameter of the screw holding part 24, therefore, significantly increases in size from its inner end to the middle and reduces in size from the middle to the front end.

Preferably, the entire screwchuck 20 or at least the screw holding portion 24 is formed by elastic materials such as plastic or metal.

The screw capturing device A has a spring loaded means 30 to always move the screwchuck 20 forward from the bushing 11. In the example shown in the drawings, the spring loaded device 30 is composed of a sleeve 31 that is slideably mounted on the outer circumference of the forward portion of the bushing 11 between the flanges 111 and 112 slideable in the direction of the axis of the bushing 11 and coil spring 32 that is located between the sleeve 31 and the rear flange 112.

By inserting the bushing 11 into the screwchuck 20 and pushing the sleeve 31 into the inner circumference of the circular portion 21 of the screwchuck 20, the screwchuck 20 and the sleeve 31 are frictionally connected. Furthermore, in the preferred embodiment of the present invention, the screw capturing device A has an adjustment ring 40 as a caliper adjustment means to adjust the inner diameter of the chuck fingers 24*a* of the screw holding means 24 of the screwchuck 20. A screw thread 41 on the inner circumference of the adjustment ring 40 matches with the screw thread 25 on the outer circumference of the circular potion 21 and the elastic circular portion 22 of the screwchuck 20. Also, for example, a roughened surface 42 is made on the outer circumference of the adjustment ring 40 to be easily rotated by finger tips.

When the adjustment ring 40 is turned in the specified direction by matching the male screw thread 25 of the screwchuck 20 frictionally engaged with the sleeve 31 and the screw thread 41 of the adjustment ring 40, the adjustment ring 40 moves forward in the direction of the axis of the screwchuck 20. During this process, it tightens the elastic circular portion 22 of the screwchuck 20 and further tightens the screwchuck 20 and the sleeve 31. And, when the adjustment ring 40 is turned in the opposite direction, it moves backward.

Since the screw holding means 24 of the screwchuck 20 significantly increases the size of the outer diameter from the base end to the middle, the caliper of the opening 24*b* is gradually reduced when the adjustment ring 40 is moved further forward when the adjustment ring 40 is turned in one direction. On the contrary, when the adjustment ring 40 is turned in the other direction and moved backward, the caliper of the opening 24*b* will be enlarged by the elastic recovery force of the fingers 24*a*.

Therefore, without replacing the screwchuck 20 for each size of the head of the screw used for tightening, several types of screws C can be tightened by using one screwchuck by operating the adjustment ring 40 to change the caliper of the opening 24*b* to be an appropriate size.

Figure 2:
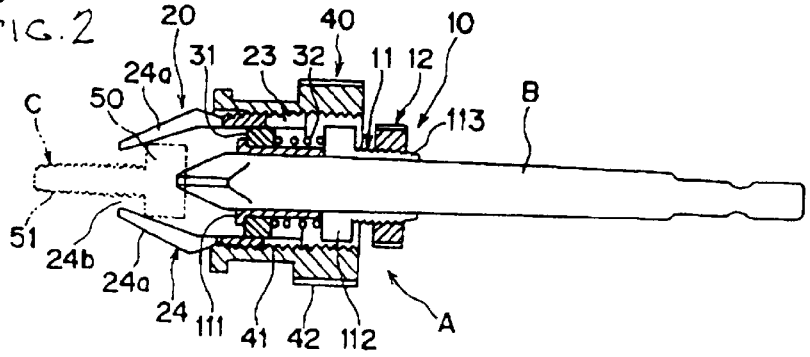
FIG. 2 is a partially sectional view of the example of the invention when it is installed on a power driven screwdriver.

When using the screw capturing apparatus A of the above construction, as shown in FIG. 2, the head 50 of the screw C (that is being held in the aforementioned screw supplier not indicated in the drawings) is pushed into the opening 24*b* of the screw holding part 24 and is captured. Since the holding fingers 24*a* are elastic, the head 50 of the screw C can be engaged by pushing the opening 24*b* of the screw holding means 24 open to capture the screw C. Therefore, the screw C can be securely captured.

When the captured screw C is screwed to an object, the threads 51 of the screw C are entered into the screw hole in the object and the front ends of the holding fingers 24*a* touch the object. The holding fingers 24*a* receive a force in the opposite direction from the direction in which the screw C is being screwed and that force is transmitted to the sleeve 31 through the screwchuck 20 to pressurize the coil spring 32. Therefore, the screw holding means 24 is retrieved as the screw C is screwed tighter. That is, the screw holding means 24 firmly supports the head of the screw C until the screw C is completely tightened. When the screw is completely screwed and the screwdriver is detached from the screw, the screw holding means 24 is returned to the initial position by the coil spring 32.

Since most of the said attachment means 10, the said spring loaded means 30, the said screw capturing means 20, and the said caliper adjustment means 40 are formed almost cylindrical and hollow inside, the screw capturing apparatus can be small and light. Therefore, without affecting load torque of the screwdriver, this apparatus can be assembled and dissembled easily. Besides, it will not be a hindrance to a screw tightening work and enables a secure screw tightening.

Furthermore, when the screwchuck 20 or at least the holding fingers 24*a* use transparent material, the screw C can be tightened while confirming the captured condition of the screw C. The screw tightening work becomes more efficient and reliable.

The screw capturing apparatus of this invention can be applied to the aforementioned various bits and screws.

As explained above, this apparatus can be easily attached to or detached from the bit of, say, an electric screwdriver. Therefore, it can be used with screws sold in retail stores. Also, since this apparatus can be used by installing to the front part of the bit of the screwdriver, it does not require new equipment like a suction pressure generating apparatus and can automatically capture a screw. Since the screw capturing device is allowed to move forward or backward by the spring loaded device, it can securely hold a screw from the beginning of the screw capturing to the completion of the screw tightening. It improves the efficiency and accuracy of the screw tightening work. Furthermore, since the screw holding part of the screw capturing device and the caliper of the opening are elastic and this apparatus has a caliper adjustment device, it can be used to tighten several types of screws of different sizes.

When the above screw capturing device is made of a transparent material, the screw capturing conditions can be confirmed and the screw can be securely and safely tightened.

The invention enables minimization, manufacturing, assembly, and installation to a bit easily. It also does not make the screw capturing apparatus a hindrance to the screw tightening work.

What is claimed is:

1. An automatic screw catching device applicable to the bit of a power driven screwdriver for driving screws into a work piece, comprising:

a bushing having a hole to insert the screwdriver bit;

means for attaching the bushing to an appropriate location close to a front end of the screw driver bit;

a sleeve mounted on the outer circumference of the bushing slideably mounted within a predetermined distance from the front end of the screwdriver bit in the direction of the axis of the bushing;

means for catching and releasing the head of a screw including a circular portion frictionally engaged with the sleeve and a plurality of circumferencially spaced resilient fingers extending from the circular portion and forming an opening to engage and catch the head of the screw;

a spring means normally biasing the sleeve forwardly with respect to the bushing;

whereby when the head of a screw is caught by the resilient fingers and engaged with the bit, the bit can rotate to drive the screw, and the resilient fingers engage the work piece to move against the normal bias of the spring means during driving of the screw and the resilient fingers open to release the head of the screw when the screw is driven into the work piece.

2. An automatic screw catching device as defined in claim 1, wherein the resilient fingers are transparent.

3. An automatic screw catching device as defined in claim 1 wherein the circular portion of the catching and releasing means is made resilient in its rear portion and has a screw thread on its outer circumference and is provided with an adjustment ring rotatably screwed onto the screw thread for firmly tightening the circular portion to the sleeve, the resilient fingers being formed externally larger between their ends, the caliper of the opening of the screw holding means being adjustable by rotating the adjustment ring.

4. An automatic screw catching device as defined in claim 2 wherein the circular portion of the catching and releasing means is made resilient in its rear portion and has a screw thread on its outer circumference and is provided with an adjustment ring rotatably screwed onto the screw thread for firmly tightening the circular portion to the sleeve, the resilient fingers being formed externally larger between their ends, the caliper of the opening of the screw holding means being adjustable by rotating the adjustment ring.

5. An automatic screw catching device applicable to the bit of a power driven screwdriver for driving screws into a work piece, comprising:

a bushing having a hole to insert the screwdriver bit;

an attachment mechanism integrally formed within or as part of the bushing and adapted to temporarily engage the bushing to the screw driver bit;

a sleeve slideably mounted on the outer circumference of the bushing for sliding movement within a predetermined distance from the front end of the screwdriver bit in the direction of the axis of the bushing;

a screw head chuck acapted to engage and catch the head of a screw, including a circular portion frictionally engaged with the sleeve and a plurality of circumferencially spaced resilient fingers extending from the circular portion and forming an opening to engage and catch the head of the screw;

a spring axially disposed on the outer circumference of the bushing, normally biasing the sleeve forwardly with respect to the bushing;

whereby when the head of a screw is caught by the resilient fingers and engaged with the bit, the bit can rotate to drive the screw.

6. The apparatus of claim 5, further comprising:

the resilient fingers are adapted to engage the work piece;

the sleeve is adapted to move over the outer circumference of the bushing against the normal bias of the spring means during driving of the screw; and, the resilient fingers are adapted to open to release the head of the screw as the screw is driven toward the work piece.

7. The apparatus of claim 5, wherein the resilient fingers are transparent.

8. The apparatus of claim 6, wherein the resilient fingers are transparent.

9. The apparatus of claim 5 further comprising:

the circular portion of the screw head chuck comprises a resilient rear portion, and a threaded outer surface;

an adjustment ring essentially concentric with circular portion of the screw head chuck and threadedly attachable the screw head chuck, and adapted to tighten the circular portion to the sleeve; and the resilient fingers being formed externally larger between their ends, the caliper of the opening of the screw engaging opening between the resilient fingers being adjustable by rotating the adjustment ring on the threads of the threaded outer surface of the circular portion of the screw head chuck.

10. The apparatus of claim 6 further comprising:

the circular portion of the screw head chuck comprises a resilient rear portion, and a threaded outer surface;

an adjustment ring essentially concentric with circular portion of the screw head chuck and threadedly attachable the screw head chuck, and adapted to tighten the circular portion to the sleeve; and the resilient fingers being formed externally larger between their ends, the caliper of the opening of the screw engaging opening between the resilient fingers being adjustable by rotating the adjustment ring on the threads of the threaded outer surface of the circular portion of the screw head chuck.

* * * * *